United States Patent [19]

Brunner et al.

[11] 3,984,138

[45] Oct. 5, 1976

[54] BALL RETRIEVER AND STORAGE UNIT

[75] Inventors: William Brunner, Wilmette; Paul Henry Hill, Chicago, both of Ill.

[73] Assignee: Hill Industries, Inc., Chicago, Ill.

[22] Filed: Nov. 7, 1974

[21] Appl. No.: 521,556

[52] U.S. Cl. ..... 294/19 A

[51] Int. Cl.[2] ..... A63B 47/02

[58] Field of Search ..... 294/19 R, 19 A, 87 R, 294/99 R; 56/328 R

[56] References Cited

UNITED STATES PATENTS

| | | | |
|---|---|---|---|
| 704,848 | 7/1902 | Minton | 294/19 A |
| 2,027,546 | 1/1936 | MacDonald | 294/19 A |
| 2,972,851 | 2/1961 | Goehring | 294/19 A X |
| 3,258,286 | 6/1966 | Coward | 294/19 A |
| 3,316,008 | 4/1967 | Baugh | 294/19 A |
| 3,371,950 | 3/1968 | Stap | 294/19 A X |
| 3,810,669 | 5/1974 | Reid | 294/19 A |
| 3,820,836 | 6/1974 | Seewagen et al. | 294/19 A |

FOREIGN PATENTS OR APPLICATIONS

| | | | |
|---|---|---|---|
| 336,951 | 3/1904 | France | 294/19 A |
| 152,771 | 6/1904 | Germany | 294/19 A |

*Primary Examiner*—Johnny D. Cherry

*Attorney, Agent, or Firm*—Hume, Clement, Brinks, William, Olds & Cook, Ltd.

[57] ABSTRACT

An apparatus for retrieving individual or a plurality of balls such as tennis balls from a playing court and for automatically storing the balls which includes a metal wire or rod frame in which the retrieved balls are stored. The frame has an exit opening at one end and an entrance opening at an opposite end thereof. Restraining rods are secured across the entrance opening and are positioned in the entrance opening to define a plurality of entry spaces of graduated dimensions, all less than the diameter of a ball so that the ball must be squeezed through the entry spaces into the central storage area afforded by the frame.

14 Claims, 5 Drawing Figures

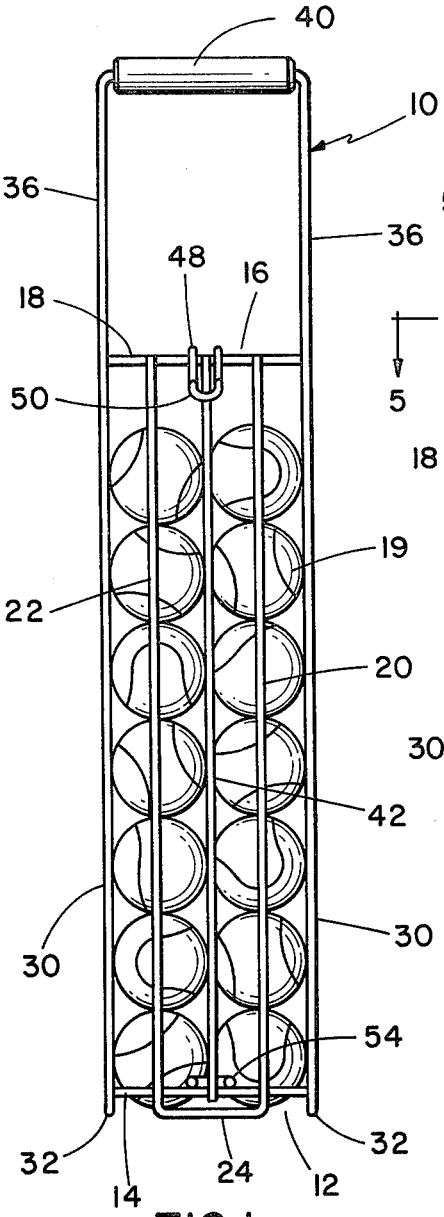
FIG.1
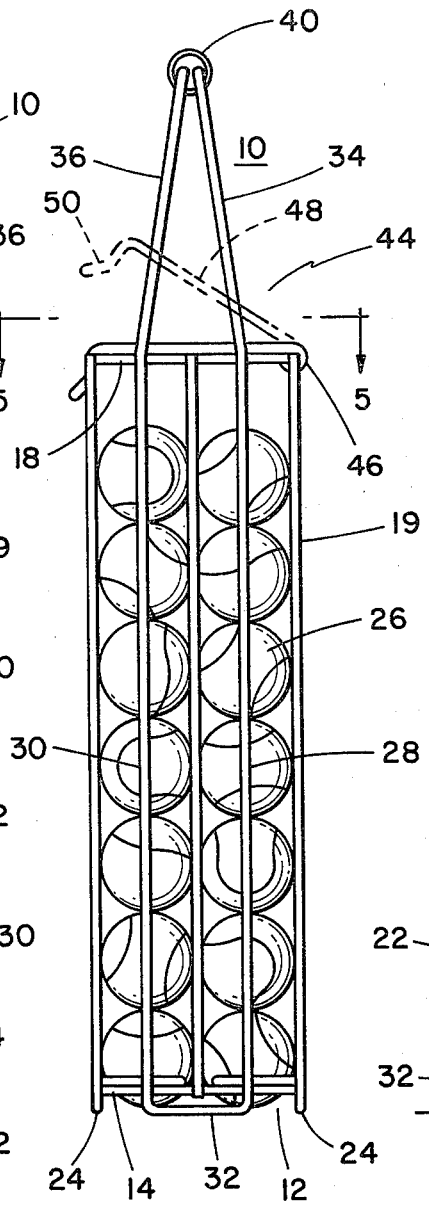
FIG.2
FIG.4
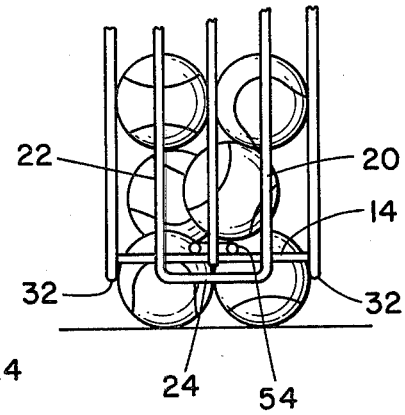
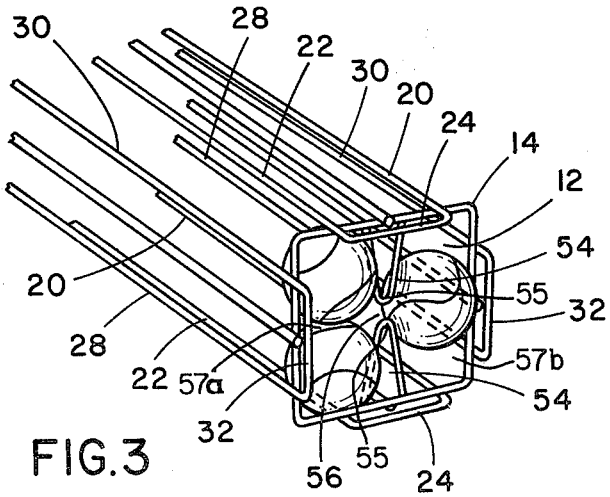
FIG.3
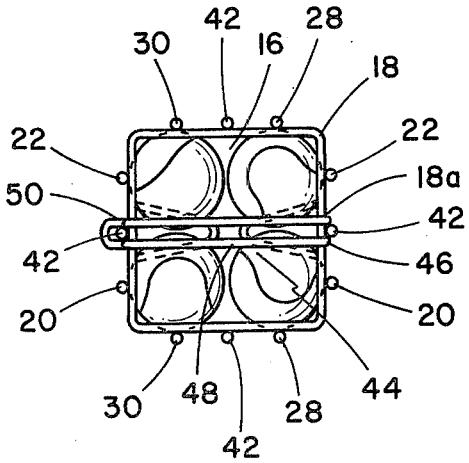
FIG.5

BALL RETRIEVER AND STORAGE UNIT

BACKGROUND OF THE INVENTION

This invention relates to retrieval and storage apparatus for balls and is primarily directed to an apparatus for retrieving and storing a plurality of game balls such as tennis balls, from a tennis court or playing field.

The game of tennis is generally taught by an instructor delivering tennis balls to a student upon a tennis court playing surface so that the student may continually hit the ball and develop the proper strokes. Machines are available for pitching the balls to the student so that the instructor may be freed for assisting the student in improving his stroke. Hundreds of tennis balls may be loaded into such machines so that the student can continue practicing for an extended period of time. Of course, after the balls have been hit by the student, they must be retrieved from the court playing surface.

The retrieval of such practice balls generally has been manual and has been performed in the same manner as the retrieval of individual tennis balls during a tennis match. Accordingly, the retrieval of several hundred tennis balls, which may be used during an instruction period, becomes a time consuming and difficult procedure.

Apparatus has been developed for simplifying the tennis ball retrieval procedure. Generally, the apparatus is a rectangular metal frame structure defining a central storage area with a grate formed over a bottom entrance. The spaces defined by the grate structure are each slightly smaller than the diameter of the tennis ball. As the tennis balls are resilient, they may be squeezed through the entry spaces for storage in the central storage area. See U.S. Pat. No. 3,371,950 for such a retriever device.

In using this prior device, if the tennis ball is not correctly aligned with an entry space in the grate, the ball may be deflected so that the player would have to chase the ball to a remote location in order to use the device again. The lack of any means for keeping the tennis balls generally in the confines of the entry spaces and for guiding the balls into proper alignment for passage through the entry spaces is a problem which has not been solved by prior art devices.

Prior art devices have had their entry spaces for balls flush with the court surface thereby permitting stored balls to contact said surface while the device is resting vertically on the surface. Such surface contact by the balls next adjacent the entry spaces can adversely affect the resiliency or lively condition thereof.

SUMMARY OF THE INVENTION

This invention provides a ball retriever and storage unit which includes an elogated metal wire or rod open frame defining a central storage area having a pair of opposed ends. There is provided an access opening at one of said ends and an entrance opening at a second end. A number of restraining or finger members are secured across the entrance opening which extend at an angle substantially perpendicular to the vertical axis of the storage area. These members are generally V-shaped and are positioned in the entrance opening with their apices spaced apart and opposed one to another so as to form constricted entry spaces for the balls. The constricted entry openings are graduated in width with the widest dimension thereof being less than the diameter of a ball to be retrieved so that the ball must be squeezed through the entry spaces into the central storage area. Further, the configuration and arrangement of the restraining member act as guides or cam means for moving a ball to a point of maximum width of the entry spaces for facilitating entry into the central storage area. Further, feet members are provided which serve to elevate the entry spaces above the ground and for preventing deflection of balls resting on the ground away from the openings when the apparatus is placed over the balls.

BRIEF DESCRIPTION OF THE DRAWINGS

FIG. 1 is a front elevation of the ball retriever and storage device of this invention;

FIG. 2 is a side elevation of the device;

FIG. 3 is a fragmentary perspective view of a portion of the device showing the entrance opening, support feet and a portion of the sides;

FIG. 4 is a fragmentary front elevation of the device shown in position to retrieve tennis balls; and FIG. 5 is a plan view of the device viewed from the position represented by the lines 5—5 in FIG. 2.

DETAILED DESCRIPTION OF THE PREFERRED EMBODIMENT

The ball retriever and storage device of this invention is shown generally by the number 10 in FIG. 1. The device includes an open metal wire or rod frame which provides the receptacle or storage compartment for the device. A bottom or entrance opening 12 to the storage receptacle is provided by a wire rod 14 bent to form a rectangle. An access opening 16 is provided by a wire rod 18 of rectangular configuration. A U-shaped framing rod 19, shown most clearly in FIG. 1, includes a first portion 20, a second portion 22 extending substantially parallel to the first portion and an end joining portion 24. The open ends of portions 20 and 22 are each secured to a point on the front side of the rectangular wire rod 18. The ends of portions 20 and 22 adjacent end joining portion 24 are secured to the front side of the rectangular wire rod 14. A second, like U-shaped wire rod 19 is secured to the wire rods 14 and 18 on the rear or opposite side thereof opposite the locations to which the first rod 19 is secured.

A wire rod 26, which includes first and second portions 28 and 30 respectively which extend parallel to one another is provided as part of the wire frame of the device 10. An end joining portion 32 interconnects first and second portions 28 and 30 at one end of these portions. Portions 34 and 36 extend from the other ends of first and second portions 28 and 30 respectively and converge towards one another. The distal ends of portions 34 and 36 are bent at right angles and fit into an end of handle 40 for carrying the device 10. The ends are shown in phantom extending into handle 40 in FIG. 1. Portions 28 and 30 are secured to one side of the rectangular rod 18 at the ends adjacent portions 34 and 36, and are secured to one side of the rectangle formed by wire rod 14 adjacent end joining portions 32. A second wire rod 26 is secured to wire rods 14 and 18 on the opposite side of the rectangle in the same manner as and at the same locations as described and shown with respect to the above described rod. Four additional wire rods 42 each have one end thereof secured to the center of a side of the rectangle formed by wire rod 14 and the other end secured to the center of the corresponding side of the rectangle formed by wire rod 18.

Portions 20 and 22 of wire rods 19, portions 28 and 30 of wire rods 26, wire rods 42, 14 and 18, secured together as described above, form the elongate frame defining a central storage area or receptacle for storing balls. As previously noted, wire rod 14 forms an entrance opening 12 and wire rod 18 forms an access opening 16. The portions 20 and 22 of rods 19, 28 and 30 of rods 26 and rods 42 are positioned with respect to another when secured to rods 14 and 18 such that the tennis balls can only enter and exit the central storage area via openings 12 and 16. That is, the spacings between these rods and rod portions are so small that a tennis ball cannot be squeezed between adjacent rods or rod portions.

As preveously noted, portions 20 and 22 of wire rods 19 extend beyond the entrance opening 12 formed by wire rod 14 and terminate at end joining portion 24. These extensions and end joining portion 24 define support feet for unit 10. The portions 28 and 30 of wire rod 26 extending below the entrance opening 12 formed by wire rod 14, and end joining portion 32 of wire rod 26 also form support feet for unit 10. These support feet, in addition to supporting unit 10, maintain entrance opening 12 a predetermined distance above the ground as can be seen by reference to FIGS. 1 and 2. With the entrance opening 12 supported above ground, balls which may be stored in unit 10 cannot come in contact with the ground.

A closure 44 formed from bent wire has one end 46 bent around the rear section 18*a* of wire rod 18. Closure member 44 can be pivoted selectively to open or closed positions. Closure member 44 includes a pair of parallel portions 48 which extends from bend end portion 46 the width of exit opening 16 and terminates in a latch 50. When closure member 44 is in its closed position, latch 50 engages against wire rod 18 and rod 42 to releasably lock the closure 44 in position preventing the stored balls from inadvertently escaping from the device 10. The restraining means for the entrance is provided by a pair of wire rod fingers 54, shown in FIG. 3. The wire fingers 54 are V-shaped. The base or wider ends of the fingers are secured to the front and rear sides of the rectangular entrance opening 12. The fingers are aligned facing one another and extend into entrance opening 12 in a plane which is substantially perpendicular to the vertical axis of the storage area. The apices 55 of fingers 54 are spaced apart a short distance or space 56. Fingers 54 and the rod 14 form two entry spaces 57*a* and 57*b* into the storage area for retrieving and storing the balls. Each of these two spaces has a point of maximum width being slightly less than the width of a tennis ball so that the tennis ball must be squeezed between rod 14 and fingers 54 at space 56 in order to permit entry of the ball into the central storage area of device 10.

When balls are to be retrieved, the device 10 is placed over the tennis balls and pressed downwardly. The support feet 24 and 32 prevent the tennis balls from being deflected away from the entrance opening 12 as the unit is lowered over the balls, as shown in FIG. 4. The members 54 and side parts of rectangular bar 14 also act as guides or cam means which urge or roll the ball towards the space 56, thus reducing the pressure necessary to allow the ball to be admitted or squeezed into the the central storage area. With slight downward pressure on the handle 40, the ball is compressed and forced between fingers 54 and rod 14 into the central storage area of device 10, thus retrieving a ball.

When stored balls are to be removed, closure member 44 is pivoted to an open position and the user may reach into the unit to remove a ball. Alternately, the user may lift the entire device 10 and pour all of the balls stored therein into a machine, such as has previously been described.

In order to prevent corrosion of the unit 10 and damage to the tennis balls due to sharp edges as the balls are squeezed into unit 10, all of the rods used in the formation of unit 10 may be coated with a colored plastic material. This material is mar and chip proof in the preferred embodiment thus minimizing the chance of rusting and corrosion to the unit and damage to the stored tennis balls.

Although the device may have special utility for retrieving tennis balls, other kinds of balls may be retrieved, so long as they have some degree of resilience which will enable them to be squeezed into the device. For instance, balls used in the game of lacrosse can be retrieved with this device.

What is to be secured by Letters Patent of the United States is:

1. A resilient-type ball retriever and storage device, comprising:

an upright open-framework receptacle for storing a plurality of balls and having access means in the upper end thereof for allowing removal of said balls from the receptacle, said receptacle having ball-entrance means formed below the storage area of said receptacle, said entrance means including a plurality of spaced angular restriction members extending in fixed position across said entrance to provide a plurality of restricted ball-entry spaces on opposite sides thereof, said restriction members being opposed and having a tapered configuration from the periphery of said entrance means to the interior of said entrance means thereby providing an optimum entry space for the ball to be squeezed past the same into said receptacle.

2. The device of claim 1, including closure means secured to said access means for preventing removal of said balls from said receptacle.

3. A resilient-type ball retriever and storage device comprising:

an elongated open framework structure defining a central storage area for storing balls, and having an access opening at a first end thereof and a ball entrance opening at a second end thereof, said ball entrance opening including a plurality of spaced angular restriction members extending in fixed position across said entrance opening at an angle substantially perpendicular to the vertical axis of the storage area to provide a plurality of ball entry spaces, said restriction members being opposed and having a tapered configuration from the periphery of said entrance opening to the interior of said entrance opening thereby providing an optimum entry space for the ball to be squeezed past the same into said storage area.

4. The device of claim 3 including closure means secured at a first location on said access opening and adapted to be pivoted selectively to a closed position for engaging said access opening at a second location whereby the access opening is blocked and the stored balls are prevented from escaping said central storage area, said closure means being adapted to pivot to a second position whereby said stored balls may be removed through said access opening.

5. A resilient-type ball retriever and storage device, comprising:

an upright open-framework receptacle for storing a plurality of balls and having access means in the upper end thereof for allowing removal of said balls from the receptacle, said receptacle having ball-entrance means formed below the storage area of said receptacle, said entrance means including means extending across said entrance to provide a restricted ball-entry space having a width less than the diameter of a ball to be retrieved so that the ball may be squeezed through the ball-entry space into said receptacle, and support means for supporting said receptacle and maintaining said ball-entrance means elevated a predetermined distance above ground level, said support means also constructed and arranged to prevent deflecting movement of balls resting on the ground as the device is used.

6. The device as claimed in claim 5 wherein said means extending across said entrance means comprises a plurality of spaced angular restriction members which provide a plurality of restricted ball-entry spaces on opposite sides of said ball-entrance means, said ball-entry spaces having graduated dimensions in width less than the diameter of a ball to be retrieved.

7. A resilient-type ball retriever and storage device, comprising:

an upright open-framework receptacle for storing a plurality of said balls and having access means in the upper end thereof for allowing removal of said balls from the receptacle, said receptacle having ball-entrance means formed below the storage area of said receptacle, said entrance means including a plurality of angular restriction members extending across said entrance to provide a plurality of restricted ball-entry spaces on opposite sides thereof which are of graduated dimension in width thereof lesser than the diameter of a ball to be retrieved, said members being opposed and spaced apart to provide an optimum entry space for the ball to be squeezed past the same into said receptacle, and support means for supporting said receptacle and maintaining said ball-entrance means elevated a predetermined distance above ground level, said support means also constructed and arranged to prevent deflecting movement of balls resting on the ground as the device is used.

8. The device as claimed in claim 7 wherein said support means are integral feet members secured adjacent said entrance means.

9. A resilient-type ball retriever and storage device, comprising:

an upright open-framework receptacle for storing a plurality of said balls and having access means in the upper end thereof for allowing removal of said balls from the receptacle, said receptacle having ball-entrance means formed below the storage area of said receptacle, said entrance means including a plurality of angular restriction members extending across said entrance to provide a plurality of restricted ball-entry spaces on opposite sides thereof which are of graduated dimension in width thereof lesser than the diameter of a ball to be retrieved, said members being opposed and spaced apart to provide an optimum entry space for the ball to be squeezed past the same into said receptacle, and said upright receptacle having walls forming a vertically oriented, hollow, rectangular chamber, said entrance means comprising a rectangular opening formed by the bottom edge of the walls of said chamber, and said angular restriction members being secured to said walls and extending into said opening and having widened ends secured to the walls and their apices adjacent to and spaced from each other at a point in said opening such that the spaces defined by said members and said side walls each have a point greater in width than at all other points therealong.

10. The device of claim 9 wherein said walls are formed from a plurality of wire rods and said angular member is formed from a bent rod.

11. The device of claim 9, including support feet extending from said walls below said opening for supporting said receptacle and maintaining said entrance means a predetermined distance above ground level, said support means acting to limit movement of balls resting on the ground away from said opening.

12. The device of claim 11 wherein said support feet are formed from bent rods.

13. A resilient-type ball retriever and storge device comprising:

an elongate open framework structure defining a central storage area for storing balls, and having an access opening at a first end thereof and a ball entrance opening at a second end thereof, said ball entrance opening including a plurality of angular restriction members extending across said entrance opening at an angle substantially perpendicular to the vertical axis of the storage area to provide a plurality of ball entry spaces which are of graduated dimension in width thereof lesser than the diameter of a ball to be retrieved, said members being opposed and spaced apart to provide substantially an optimum entry space for the ball to be squeezed past the same into said storage area, and feet extending beyond said entrance opening for supporting said device and maintaining said ball entrance opening elevated a predetermined distance above the ground level, said feet constructed and arranged to prevent deflecting movement of the balls resting on the ground as the device is used.

14. A resilient-type ball retriever and storage device comprising:

an elongate open framework structure defining a central storage area for storing balls, and having an access opening at a first end thereof and a ball entrance opening at a second end thereof, said ball entrance opening at a second end thereof, said ball entrance opening including a plurality of angular restriction members extending across said entrance opening at an angle substantially perpendicular to the vertical axis of the storage area to provide a plurality of ball entry spaces which are of graduated dimension in width thereof lesser than the diameter of a ball to be retrieved, said members being opposed and spaced apart to provide substantially an optimum entry space for the ball to be squeezed past the same into said storage area, and handle means secured to said frame for carrying and lifting said frame and positioned such that said access and entrance openings are substantially vertically aligned with respect to another when said device is lifted or carried, said handle means including first portions secured to said elongate frame and extending the length thereof for complementing said frame structure and preventing escape of said stored tennis balls, and second portions extending beyond said entrance opening and forming feet for supporting said device and maintaining said entrance opening a predetermined distance above the ground level, said second portions constructed and arranged to prevent deflecting movement of said ball resting on the ground as the device is used.

* * * * *